US012589835B2

(12) United States Patent
Jessamine

(10) Patent No.: US 12,589,835 B2
(45) Date of Patent: Mar. 31, 2026

(54) BUOYANCY SUPPLEMENT

(71) Applicant: Andrew Jessamine, Roy, UT (US)

(72) Inventor: Andrew Jessamine, Roy, UT (US)

( * ) Notice: Subject to any disclaimer, the term of this patent is extended or adjusted under 35 U.S.C. 154(b) by 705 days.

(21) Appl. No.: 17/817,974

(22) Filed: Aug. 5, 2022

(65) Prior Publication Data

US 2023/0039238 A1 Feb. 9, 2023

Related U.S. Application Data

(60) Provisional application No. 63/230,911, filed on Aug. 9, 2021.

(51) Int. Cl.

| | |
|---|---|
| ***B63B 3/08*** | (2006.01) |
| ***B63B 34/00*** | (2020.01) |
| ***B63B 34/10*** | (2020.01) |
| ***B63C 1/02*** | (2006.01) |

(52) U.S. Cl.

CPC ..... *B63B 3/08* (2013.01); *B63B 34/05* (2020.02); *B63B 34/10* (2020.02); *B63C 1/02* (2013.01); *B63B 2207/02* (2013.01)

(58) Field of Classification Search

CPC .. B63B 3/00; B63B 3/08; B63B 35/00; B63B 35/58; B63B 34/00; B63B 34/05; B63B 34/10; B63B 34/52; B63C 1/00; B63C 1/02; B63H 7/00; B63H 7/08

USPC ..... 114/258, 346, 345; 441/66, 67

See application file for complete search history.

(56) References Cited

U.S. PATENT DOCUMENTS

| | | | | |
|---|---|---|---|---|
| 2,674,753 A * | 4/1954 | Wood | B63B 34/05 | 441/130 |
| 3,665,534 A * | 5/1972 | McIntyre | B63B 7/087 | 114/343 |
| 5,090,930 A * | 2/1992 | Walden | B63B 34/52 | 114/345 |
| 5,485,981 A * | 1/1996 | Lindahl | B63B 34/05 | 114/345 |
| 6,142,839 A * | 11/2000 | Wilcox | B63B 34/05 | 114/345 |
| 6,490,989 B1 * | 12/2002 | Ray | B63B 7/087 | 114/352 |
| 6,543,378 B1 * | 4/2003 | Johnson, Sr. | B63B 34/10 | 114/345 |

* cited by examiner

*Primary Examiner* — Lars A Olson
(74) *Attorney, Agent, or Firm* — Steven Rinehart

(57) ABSTRACT

Described herein are examples of buoyancy supplements. A buoyancy supplement may include a system including a front flotation portion including a front deck having a front surface, a rear flotation portion including a rear deck having a rear surface. One or both front and rear surfaces having an accessory attachment point, a through-hole substantially parallel to the front or rear surface, a mounting apparatus, a tie-down anchor, and a first and second runner each having a first end configured to attach to the front flotation portion and a second end configured to attach to the rear flotation portion. The front flotation portion and the rear flotation portion may be configured to attach to a float tube.

9 Claims, 5 Drawing Sheets

BUOYANCY SUPPLEMENT

CROSS-REFERENCE TO RELATED APPLICATIONS

The present application claims the benefit of U.S. Provisional Patent Application No. 63/230,911 entitled "BUOYANCY SUPPLEMENT", filed on Aug. 9, 2021. The entire contents of the above-listed application are hereby incorporated by reference for all purposes.

BACKGROUND

Personal watercraft or flotation devices may be used by individuals needing to float at or near a surface of a body of water. For instance, a fisher may utilize a float tube to enable flotation near the surface of a body of water in which the fisher is fishing.

BRIEF DESCRIPTION OF THE DRAWINGS

The present description will be understood more fully when viewed in conjunction with the accompanying drawings of various examples of buoyancy supplements. The description is not meant to limit the buoyancy supplements to the specific examples. Rather, the specific examples depicted and described are provided for explanation and understanding of buoyancy supplements. Throughout the description the drawings may be referred to as drawings, figures, and/or FIGS.

DETAILED DESCRIPTION

Figure 1A:
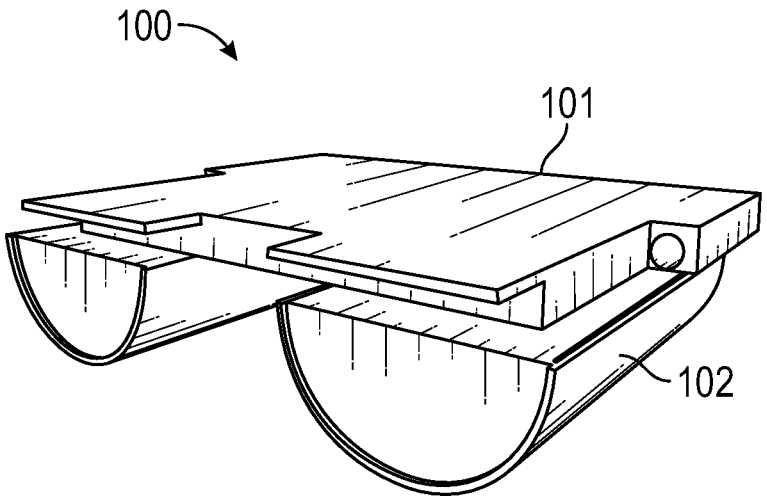
FIG. 1A illustrates a front flotation portion of a buoyancy supplement, according to an embodiment.

Buoyancy supplements as disclosed herein will become better understood through a review of the following detailed description in conjunction with the figures. The detailed description and figures provide merely examples of the various embodiments of buoyancy supplements. Many variations are contemplated for different applications and design considerations; however, for the sake of brevity and clarity, all the contemplated variations may not be individually described in the following detailed description. Those skilled in the art will understand how the disclosed examples may be varied, modified, and altered and not depart in substance from the scope of the examples described herein.

A conventional system used for floating on a body of water may include a float tube configured to enable a person to stand, sit, or kneel on the personal flotation device. A buoyancy supplement may be considered integral to the float tube, and may take the form of, for example, a pontoon or inflatable portion of the float tube.

Conventional float tubes may ride low in the water, for instance, when used by a heavier person or the addition of gear and tackle to be carried by the float tube. Such float tubes may further lack versatility in enabling a person to ride in various positions or attach various accessories. Further, conventional float tubes may be bulky and not streamlined, thus placing strain on a trolling motor.

Implementations of buoyancy supplements may address some or all of the problems described above. A buoyancy supplement may include rigid additions, decks, and pontoons which can be removably added to float tubes as a buoyancy supplement. A buoyancy supplement may include a system, which may include a front flotation portion including a front deck, a rear flotation portion including a rear deck, and a runner having a first end configured to attach to the front flotation portion and a second end configured to attach to the rear flotation portion. The front flotation portion and the rear flotation portion may be configured to attach to a float tube.

Such buoyancy supplements may increase buoyancy and water ride height for a personal flotation device, thus increasing a weight capacity of a personal flotation device the buoyancy supplement is connected to, provide a standing deck for casting, provide an accessory attachment location, and provide a streamlined design, thereby decreasing strain on trolling motors.

Portions of the buoyancy supplements may be constructed of plastic, for example, ABS, polylactic acid (PLA), polycarbonate (PG), polyethylene terephthalate (PET, PETT, PETG, PETE), nylon, high density polyethylene (HDPE), polyvinyl chloride (PVC), low density polyethylene (LDPE), polypropylene (PP), or polystyrene, or other suitable plastics. All or a portion of the buoyancy supplements may be manufactured by, for example, injection molding, additive manufacturing, or machining.

Embodiments may include through-holes, which may be parallel to the runners. The through-holes may be used to attach the buoyancy supplement to the personal flotation device or other accessories used by a person utilizing a personal flotation device.

Embodiments may include deck portions composing a deck, which can be used for, for example, sitting, kneeling, or standing. For example, a fisher may stand on the deck to cast a line.

FIG. 1A illustrates a front flotation portion 100 of a buoyancy supplement, according to an embodiment. The front flotation portion 100 of the buoyancy supplement may be configured to provide additional buoyancy to a personal flotation device to which it is connected.

The front flotation portion 100 of the buoyancy supplement may include a deck 101 and a runner 102. The runner 102 may comprise an entire runner or a portion of a runner (e.g., runner 500), which may additionally connect to a rear flotation portion of the buoyancy supplement.

Figure 1B:
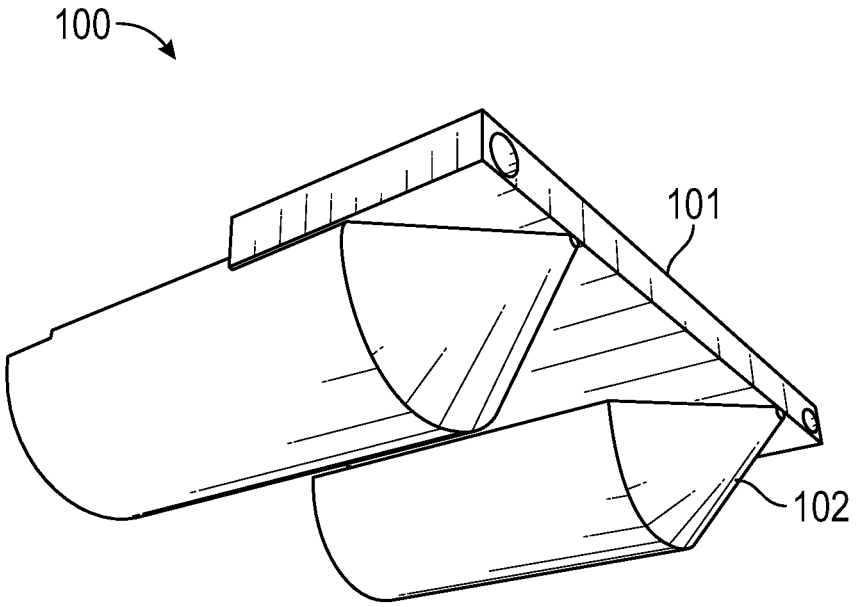
FIG. 1B illustrates another view of a front flotation portion of a buoyancy supplement, according to an embodiment.

FIG. 1B illustrates another view of the front flotation portion 100, according to an embodiment. The view of FIG. 1B illustrates a portion of the runner 102 connected to the front flotation portion 100 as well as the geometry of the runner 102.

The geometry of the runner 102 may be that of a partial cylinder, sliced along a diameter or chord. An end of the runner 102 may be configured with a streamlined geometry (e.g., a cone or conical section), which may decrease drag in the water and thus decrease the effort with which the buoyancy supplement and attached personal flotation device can be moved. In embodiments where a trolling motor is used to propel the buoyancy supplement and attached personal flotation device, the streamlined geometry at the end of the runner 102 may decrease strain when the trolling motor is in use.

Figure 2:
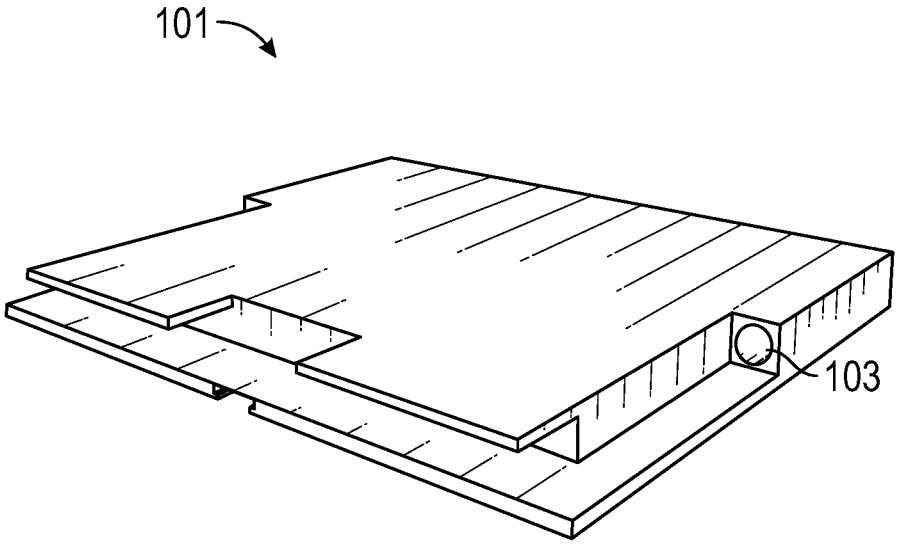
FIG. 2 illustrates a deck of a front flotation portion of a buoyancy supplement, according to an embodiment.

FIG. 2 illustrates the deck 101 of a front portion of a buoyancy supplement, according to an embodiment. The deck 101 may provide a surface upon which a fisher can, for example, sit, kneel, or stand.

The deck 101 may be sized and configured to provide for support of, for example, a personal flotation device, gear, tackle, a chair, or a person. The deck 101 may include accessory attachment points, for example, a rod holder configured to hold a fishing rod. The deck 101 may further comprise tie-down anchors, which may be used for tying ropes to, for example for securing the personal flotation device connected to the buoyancy supplement to a dock.

The deck 101 may further include a through-hole 103, which may be substantially parallel to the top surface of the deck 101. The through-hole 103 may be configured to enable connection of the buoyancy supplement to a float tube, a chair, or another attachment.

Figure 3A:
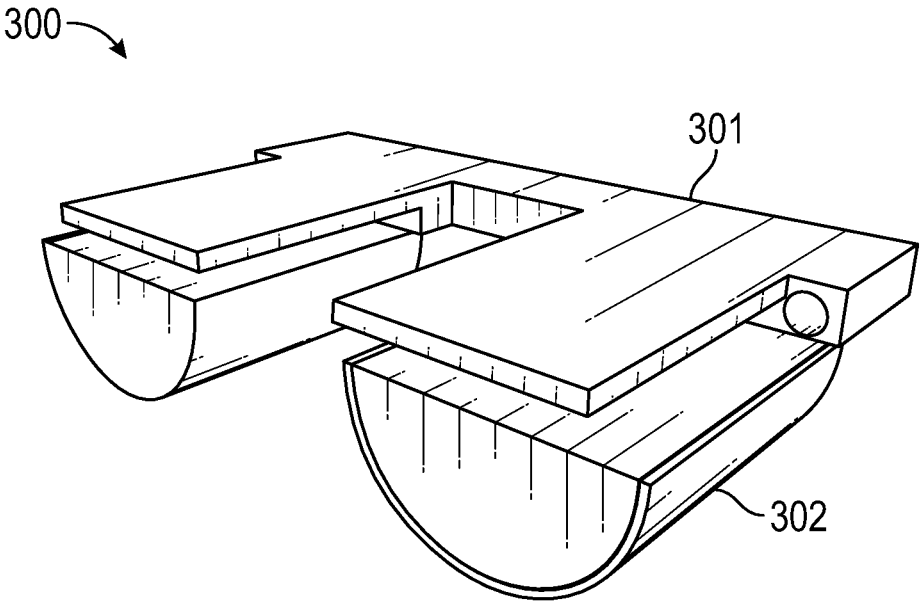
FIG. 3A illustrates a rear flotation portion of a buoyancy supplement, according to an embodiment.

FIG. 3A illustrates a rear flotation portion 300 of a buoyancy supplement, according to an embodiment. The rear flotation portion 400 of the buoyancy supplement may be configured to provide additional buoyancy to a personal flotation device to which it is connected.

The rear flotation portion 300 of the buoyancy supplement may include a deck 301 and a runner 302. The runner 302 may comprise an entire runner or a portion of a runner (e.g., runner 500), which may additionally connect to a rear flotation portion of the buoyancy supplement.

Figure 3B:
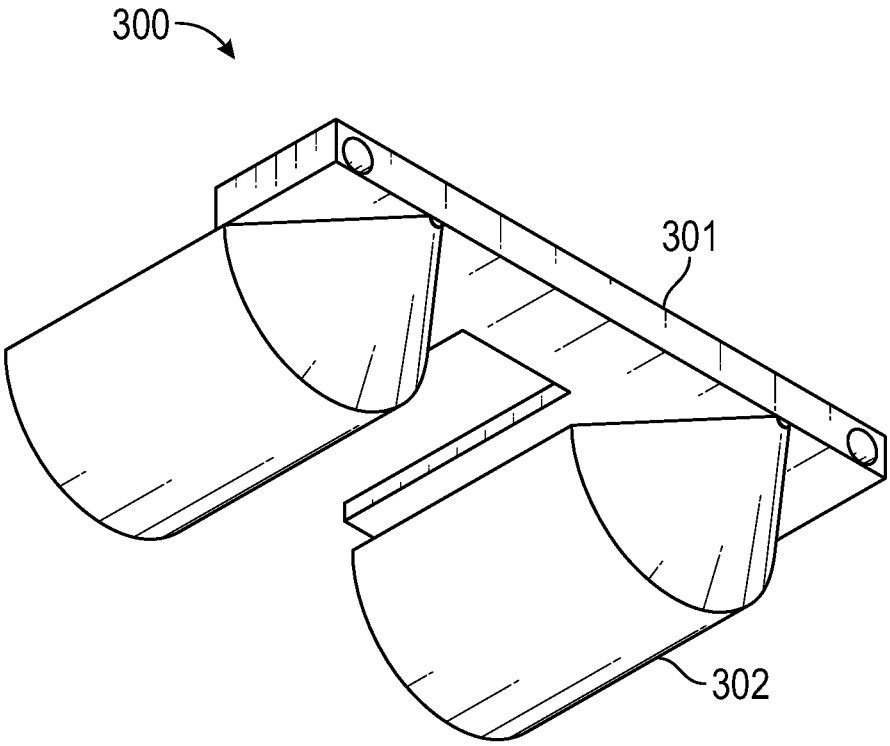
FIG. 3B illustrates another view of a rear flotation portion of a buoyancy supplement, according to an embodiment.

FIG. 3B illustrates another view of the rear flotation portion 300, according to an embodiment. The view of FIG. 3B illustrates a portion of the runner 302 connected to the rear flotation portion 300 as well as the geometry of the runner 302.

The geometry of the runner 302 may be that of a partial cylinder, sliced along a diameter or chord. An end of the runner 302 may be configured with a streamlined geometry (e.g., a cone or conical section), which may decrease drag in the water and thus decrease the effort with which the buoyancy supplement and attached personal flotation device can be moved. In embodiments where a trolling motor is used to propel the buoyancy supplement and attached personal flotation device, the streamlined geometry at the end of the runner 302 may decrease strain when the trolling motor is in use.

Figure 4:
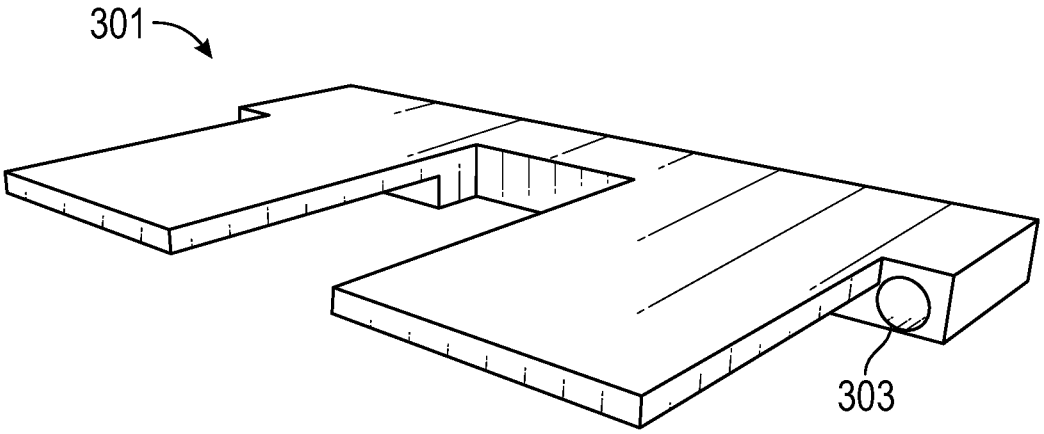
FIG. 4 illustrates a deck of a rear flotation portion of a buoyancy supplement, according to an embodiment.

FIG. 4 illustrates the deck 301 of a rear flotation portion of a buoyancy supplement, according to an embodiment. The deck 301 may provide a surface upon which a fisher can, for example, sit, kneel, or stand.

The deck 301 may be sized and configured to provide for support of, for example, a personal flotation device, gear, tackle, a chair, or a person. The deck 301 may include accessory attachment points, for example, a rod holder configured to hold a fishing rod. The deck 301 may further comprise tie-down anchors, which may be used for tying ropes to, for example for securing the personal flotation device connected to the buoyancy supplement to a dock. The deck 301 may further include a mounting apparatus, for example, for mounting a trolling motor, which may be used to propel the personal flotation device.

The deck 301 may further include a through-hole 303, which may be substantially parallel to the top surface of the deck 301. The through-hole 303 may be configured to enable connection of the buoyancy supplement to a float tube, a chair, or another attachment.

Figure 5:
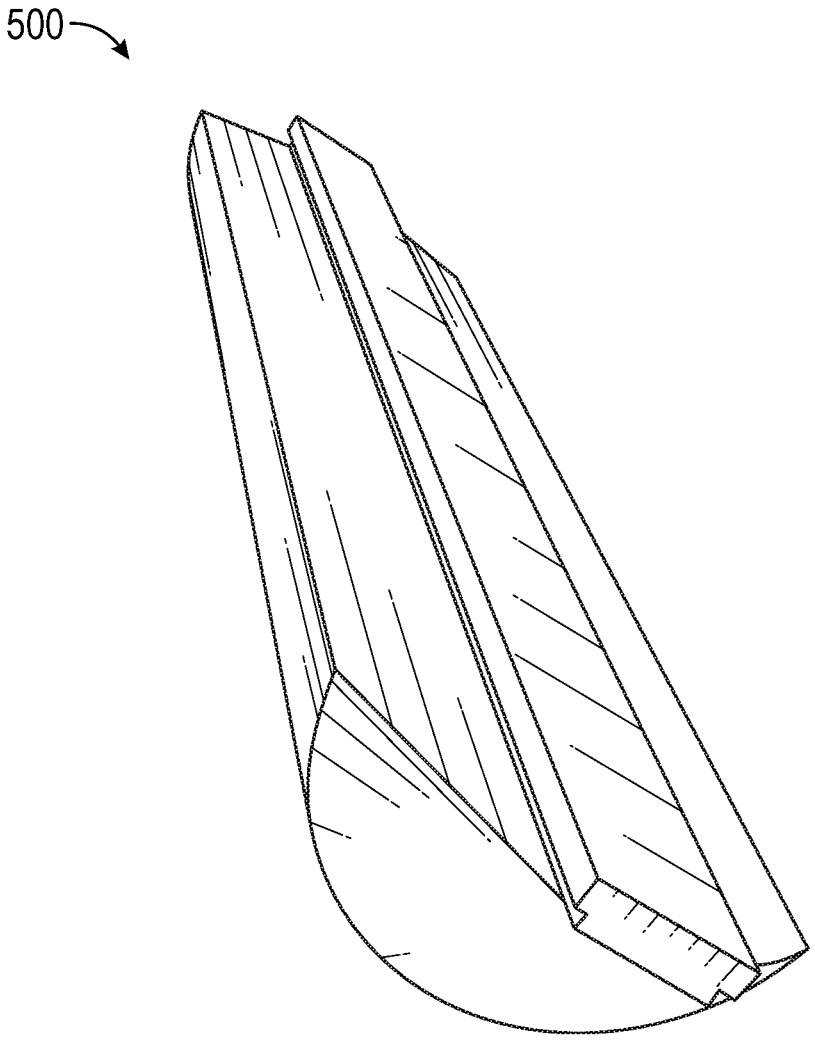
FIG. 5 illustrates a runner of a buoyancy supplement, according to an embodiment.

FIG. 5 illustrates a runner 500 of a buoyancy supplement, according to an embodiment. The runner 500 may be configured as a pontoon and may provide additional buoyancy to a personal flotation device.

The runner 500 may share a geometry at its ends as described above with respect to the runners 102 and 302. In some embodiments, runner 500 may include the runners 102 and 302, which may themselves represent portions of either a monolithic or assembled runner 500. The runner 500 may have a hollow construction, with a wall thickness selected for the necessary integrity of navigating a given body of water, for instance, a lake. In this way, the runner 500 may have a wall thickness sufficient to withstand, for example, puncture by a stick or rock.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (i.e., methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively-inclusive elements includes at least one element of the listed elements. However, an example described using a list of alternatively-inclusive elements does not preclude another example that includes all of the listed elements. And, an example described using a list of alternatively-inclusive elements does not preclude another example that includes a combination of some of the listed elements. As used herein regarding a list, "and/or" forms a list of elements inclusive alone or in any combination. For example, an example described as including A, B, C, and/or D is an example that may include: A alone; A and B; A, B and C; A, B, C, and D; and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples that are believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower or equal in scope to the original claims, are to be considered within the subject matter of the examples described herein.

The invention claimed is:

1. A buoyancy system, comprising:

a front flotation portion comprising a front deck, wherein the front deck comprises a front surface comprising:

at least one front through-hole substantially parallel to the front surface;

at least one front accessory attachment point, and at least one front tie-down anchor;

a rear flotation portion comprising a rear deck, wherein the rear deck comprises a rear surface comprising:

at least one rear through-hole substantially parallel to the rear surface, at least one rear accessory attachment point, at least one rear tie-down anchor, and a mounting apparatus;

a first runner;

a second runner; and wherein the front flotation portion and the rear flotation portion are configured to attach to a float tube.

2. The buoyancy system of claim 1, wherein the front accessory attachment point, rear accessory attachment point, or both the front accessory attachment point and rear accessory attachment point comprises a recess.

3. The buoyancy system of claim 1, wherein the front accessory attachment point, rear accessory attachment point, or both the front accessory attachment point and rear accessory attachment point comprises a mount.

4. The buoyancy system of claim 1, wherein the front tie-down anchor, rear tie-down anchor, or both the front tie-down anchor and rear tie-down anchor is removable.

5. The buoyancy system of claim 1, wherein the mounting apparatus is configured to mount a motor.

6. The buoyancy system of claim 1, wherein the first runner, the second runner, or both the first runner and the second runner is a partial cylinder.

7. The buoyancy system of claim 1, wherein the first runner, the second runner, or both the first runner and the second runner is monolithic or assembled.

8. A buoyancy system, comprising:

a front flotation portion comprising a front deck, wherein the front deck comprises a front surface;

a rear flotation portion comprising a rear deck, wherein the rear deck comprises a rear surface;

wherein one of either the front surface or the rear surface further comprises:

a through-hole substantially parallel to the rear surface, an accessory attachment, a tie-down anchor, wherein the tie-down anchor is removable, and a mounting apparatus;

a first runner;

a second runner; and wherein the first and second runner each have a first end configured to attach to the front flotation portion and a second end configured to attach to the rear flotation portion; and wherein the front flotation portion and the rear flotation portion and configured to attach to a float tube.

9. A buoyancy system, comprising:

a front flotation portion comprising a front deck, wherein the front deck comprises a front surface;

a rear flotation portion comprising a rear deck, wherein the rear deck comprises a rear surface;

wherein one of either the front surface or the rear surface further comprises:

a through-hole substantially parallel to the rear surface, an accessory attachment, a tie-down anchor, wherein the tie-down anchor is removable, and a mounting apparatus;

a first runner;

a second runner; and wherein the first and second runner each have a first end configured to attach to the front flotation portion and a second end configured to attach to the rear flotation portion;

wherein the front flotation portion and the rear flotation portion and configured to attach to a float tube; and wherein the first runner, the second runner, or both the first and second runner is a partial cylinder.

* * * * *